US006314648B1

(12) United States Patent
Hillebrandt

(10) Patent No.: US 6,314,648 B1
(45) Date of Patent: Nov. 13, 2001

(54) DUAL BLADE HAIR CLIPPER

(76) Inventor: Daniel J. Hillebrandt, 1411 Railroad Ave., Morgan City, LA (US) 70380

( * ) Notice: Subject to any disclaimer, the term of this patent is extended or adjusted under 35 U.S.C. 154(b) by 0 days.

(21) Appl. No.: 09/388,420

(22) Filed: Sep. 1, 1999

(51) Int. Cl.[7] ..... B26B 19/00; B26B 19/06; B26B 19/10; B26B 19/12

(52) U.S. Cl. ..... 30/208; 30/34.1; 30/210; 30/216; 30/241; 30/228

(58) Field of Search ..... 30/34.1, 123.3, 30/131, 208, 210, 228, 241, 277.4, 216, 34.05, 50, 537, DIG. 1, DIG. 2

(56) References Cited

U.S. PATENT DOCUMENTS

| | | | | |
|---|---|---|---|---|
| 1,380,272 | * | 5/1921 | Tomasulo | 30/34.1 X |
| 2,300,143 | * | 10/1942 | Berg | 30/34.1 |
| 3,279,062 | | 10/1966 | Andis | 30/210 |
| 3,372,481 | | 3/1968 | Skinner | 30/210 |
| 4,081,905 | | 4/1978 | Urbush | 30/221 |
| 4,383,366 | | 5/1983 | Andis | 30/221 |
| 4,498,237 | | 2/1985 | Mack et al. | 30/200 |
| 5,054,199 | * | 10/1991 | Ogawa et al. | 30/34.1 |
| 5,105,541 | * | 4/1992 | Messinger et al. | 30/34.1 |
| 5,230,153 | | 7/1993 | Andis | 30/216 |
| 5,483,745 | * | 1/1996 | Izumi | 30/DIG. 2 |

* cited by examiner

*Primary Examiner*—Boyer Ashley
(74) *Attorney, Agent, or Firm*—Joseph N. Breaux

(57) ABSTRACT

A hair clipper unit that includes edger blades on one end and taper blades on the other end. The clipper system allows a stylist to rapidly switch operation between the two sets of clipper blades and includes a power cord directing assembly including a power cord that extends from a center side surface of a motor housing and a cord securing clip on either side of the cord housing exit point for holding the cord in the proper orientation during use. The dual blade clipper unit also includes two separate drive motors, one for each set of clipping blades, and a drive motor cooling system to further reduce the heat generated by operation of the clipper unit.

1 Claim, 4 Drawing Sheets

DUAL BLADE HAIR CLIPPER

TECHNICAL FIELD

The present invention relates to grooming devices and more particularly to a dual blade hair clipper system that includes a motor housing, an independently powered edger unit, an independently powered taper unit, a power cord directing assembly, a three-position on/off switch, and a motor cooling system; the motor housing being sized to provide a handle graspable by a hand of a user; the independently powered edger unit including an edger unit drive motor housed within the motor housing and an edger blade assembly, powered by the edger unit drive motor, provided at one end of the motor housing; the independently powered taper unit including a taper unit drive motor housed within the motor housing and an adjustable taper blade assembly, powered by the taper unit drive motor, provided at an opposite end of the motor housing; the power cord directing assembly including a power cord extending out from a side surface of the motor housing midway between the edger blade assembly and the taper blade assembly and two cord securing clips, one of the two cord securing clips being provided on either side of a power cord motor housing exit point; each cord securing clip having a lateral insertion opening through which a section of the power cord is snap fit to form a connection between the section of power cord and the cord securing clip; the three-position on/off switch being wired in controlling connection with the taper unit drive motor and the edger unit drive motor such that in a first switch position the taper unit drive motor is on, in a second switch position the edger unit drive motor is on, and in a third switch position both the taper unit drive motor and the edger unit drive motor are off; the motor cooling system including a fan assembly positioned within the motor housing and in air flow connection with a number of air vent openings formed through the motor housing such that operation of the fan assembly causes air to flow into, through and out of the motor housing; the air vent openings being positioned on the motor housing such that air flow is directed onto the edger unit drive motor and the taper unit drive motor; the fan assembly being in controlled connection with the three-position switch such that the fan assembly operates when the three-position switch is in the first and second switch positions.

BACKGROUND ART

Cutting hair can require the use of both taper clippers and edger clippers for performing different cutting and shaping procedures on a client's hair. The hairstylist is, therefore, required to switch back and forth between two separate clipper devices which can require walking back and forth to a counter top or the like and can break the stylist's concentration. It would be a benefit, therefore, to have a clipper unit that included both edger blades on one end and taper blades on the other end that allowed the stylist to rapidly switch operation of the clipper device between the two sets of blades. In addition, because the heat generated by operating the clipper unit drive motor can be uncomfortable for the stylist and the client, it would be a further benefit to have a dual blade clipper unit that included two separate drive motors, one for each set of clipping blades, to allow heat generated in one drive motor to dissipate while the stylist is using the clipper blades driven by the other drive motor. It would also be a benefit to have a drive motor cooling system to further reduce the heat generated by operation of the drive motors.

GENERAL SUMMARY DISCUSSION OF INVENTION

It is thus an object of the invention to provide a dual blade hair clipper system that includes a motor housing, an independently powered edger unit, an independently powered taper unit, a power cord directing assembly, a three-position on/off switch, and a motor cooling system; the motor housing being sized to provide a handle graspable by a hand of a user; the independently powered edger unit including an edger unit drive motor housed within the motor housing and an edger blade assembly, powered by the edger unit drive motor, provided at one end of the motor housing; the independently powered taper unit including a taper unit drive motor housed within the motor housing and an adjustable taper blade assembly, powered by the taper unit drive motor, provided at an opposite end of the motor housing; the power cord directing assembly including a power cord extending out from a side surface of the motor housing midway between the edger blade assembly and the taper blade assembly and two cord securing clips, one of the two cord securing clips being provided on either side of a power cord motor housing exit point; each cord securing clip having a lateral insertion opening through which a section of the power cord is snap fit to form a connection between the section of power cord and the cord securing clip; the three-position on/off switch being wired in controlling connection with the taper unit drive motor and the edger unit drive motor such that in a first switch position the taper unit drive motor is on, in a second switch position the edger unit drive motor is on, and in a third switch position both the taper unit drive motor and the edger unit drive motor are off; the motor cooling system including a fan assembly positioned within the motor housing and in air flow connection with a number of air vent openings formed through the motor housing such that operation of the fan assembly causes air to flow into, through and out of the motor housing; the air vent openings being positioned on the motor housing such that air flow is directed onto the edger unit drive motor and the taper unit drive motor; the fan assembly being in controlled connection with the three-position switch such that the fan assembly operates when the three-position switch is in the first and second switch positions.

Accordingly, a dual blade hair clipper system is provided. The dual blade hair clipper system includes a motor housing, an independently powered edger unit, an independently powered taper unit, a power cord directing assembly, a three-position on/off switch, and a motor cooling system; the motor housing being sized to provide a handle graspable by a hand of a user; the independently powered edger unit including an edger unit drive motor housed within the motor housing and an edger blade assembly, powered by the edger unit drive motor, provided at one end of the motor housing; the independently powered taper unit including a taper unit drive motor housed within the motor housing and an adjustable taper blade assembly, powered by the taper unit drive motor, provided at an opposite end of the motor housing; the power cord directing assembly including a power cord extending out from a side surface of the motor housing midway between the edger blade assembly and the taper blade assembly and two cord securing clips, one of the two cord securing clips being provided on either side of a power cord motor housing exit point; each cord securing clip having a lateral insertion opening through which a section of the power cord is snap fit to form a connection between the section of power cord and the cord securing clip; the three-position on/off switch being wired in controlling connection with the taper unit drive motor and the edger unit drive motor such that in a first switch position the taper unit drive motor is on, in a second switch position the edger unit drive motor is on, and in a third switch position both the taper unit drive motor and the edger unit drive motor are off; the motor cooling system including a fan assembly positioned within the motor housing and in air flow connection with a number of air vent openings formed through the motor housing such that operation of the fan assembly causes air to flow into, through and out of the motor housing; the air vent openings being positioned on the motor housing such that air flow is directed onto the edger unit drive motor and the taper unit drive motor; the fan assembly being in controlled connection with the three-position switch such that the fan assembly operates when the three-position switch is in the first and second switch positions.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
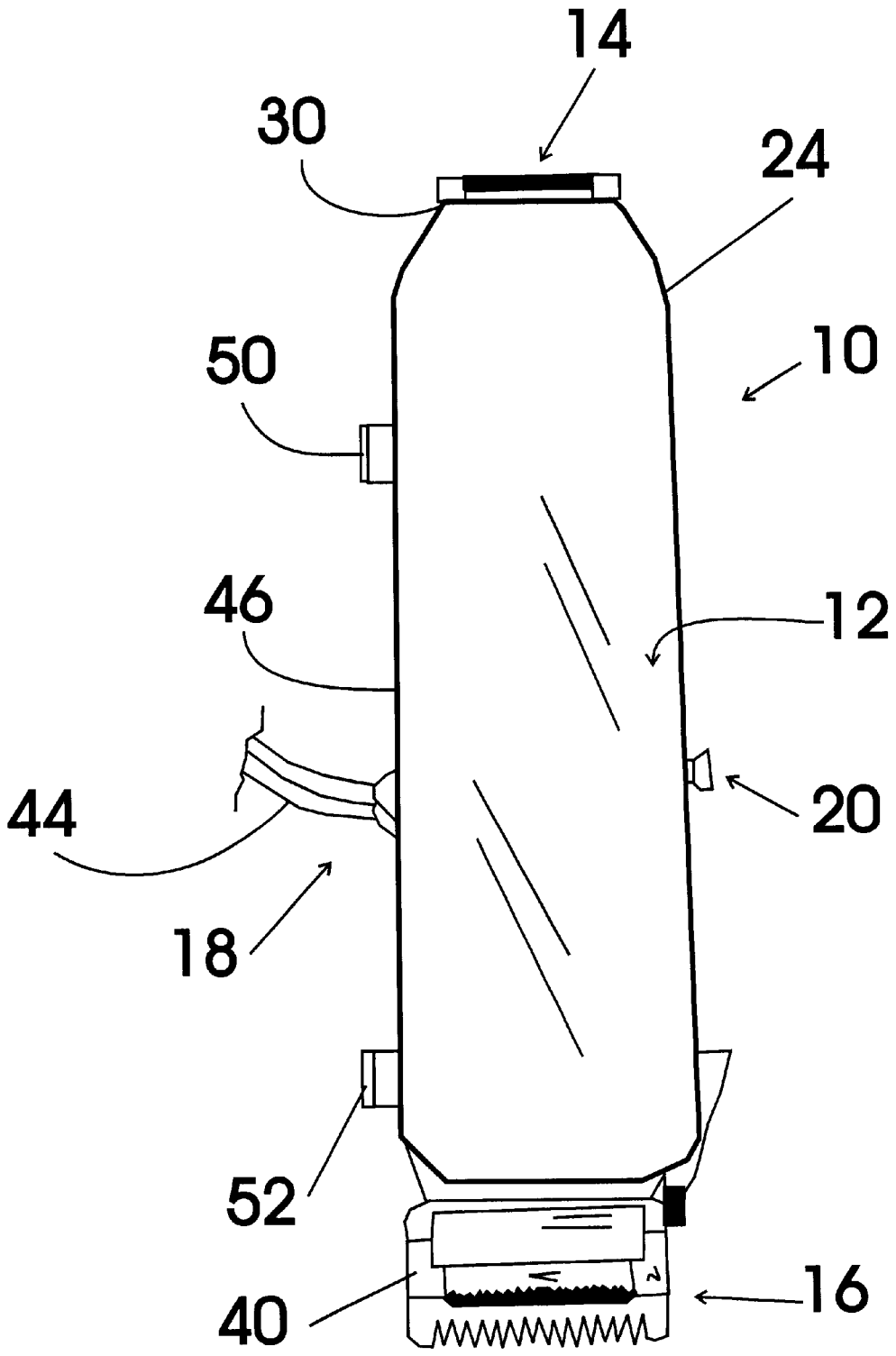
FIG. 1 is a top side view of an exemplary embodiment of the dual blade hair clipper system of the present invention showing the motor housing; the edger blade assembly of an independently powered edger unit provided at one end of the motor housing; the adjustable taper blade assembly of the independently powered taper unit provided at an opposite end of the motor housing; a power cord directing assembly including a power cord extending out from a side surface of the motor housing midway between the edger blade assembly and the taper blade assembly and two cord securing clips one provided on either side of the power cord motor housing exit point, each cord securing clip having a lateral insertion opening through which a section of the power cord is snap fit to form a connection between the power cord and the cord securing clip; a three-position on/off switch wired in controlling connection with the taper unit drive motor and the edger unit drive motor such that in a first switch position the taper unit drive motor is on, in a second switch position the edger unit drive motor is on, and in a third switch position both the taper unit drive motor and the edger unit drive motor are off; a motor cooling system including a fan assembly positioned in connection with a number of air vent openings through the motor housing such that operation of the fan assembly causes air flow into, through and out of the motor housing; the fan assembly being in controlled connection with the three-position switch such that the fan assembly operates when the three-position switch is in the first and second switch positions.
Figure 2:
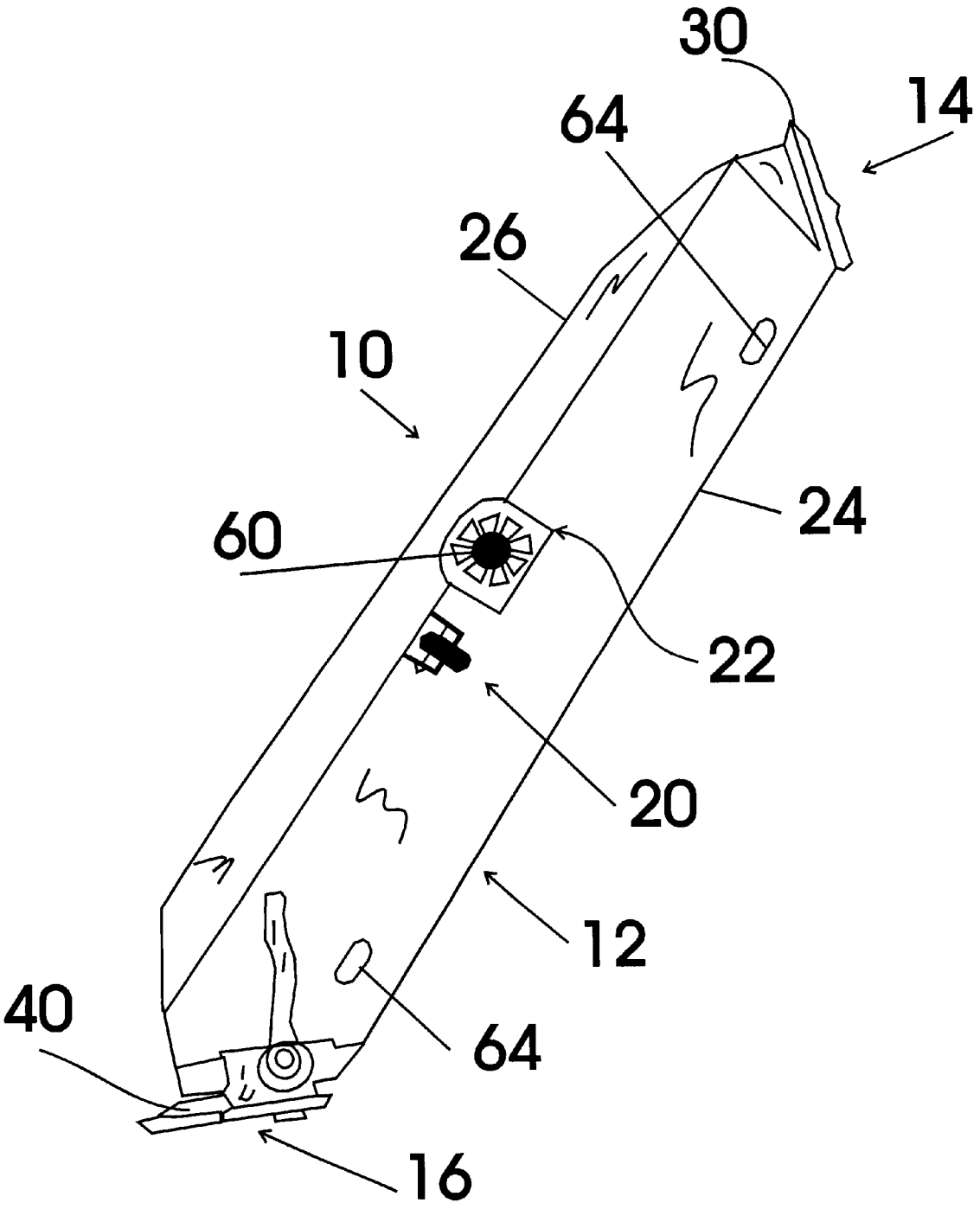
FIG. 2 is a side plan view showing the power cord directing assembly including the power cord extending out from a side surface of the motor housing midway between the edger blade assembly and the taper blade assembly and two cord securing clips one provided on either side of the power cord motor housing exit point, and two of the four air vent openings.
Figure 3:
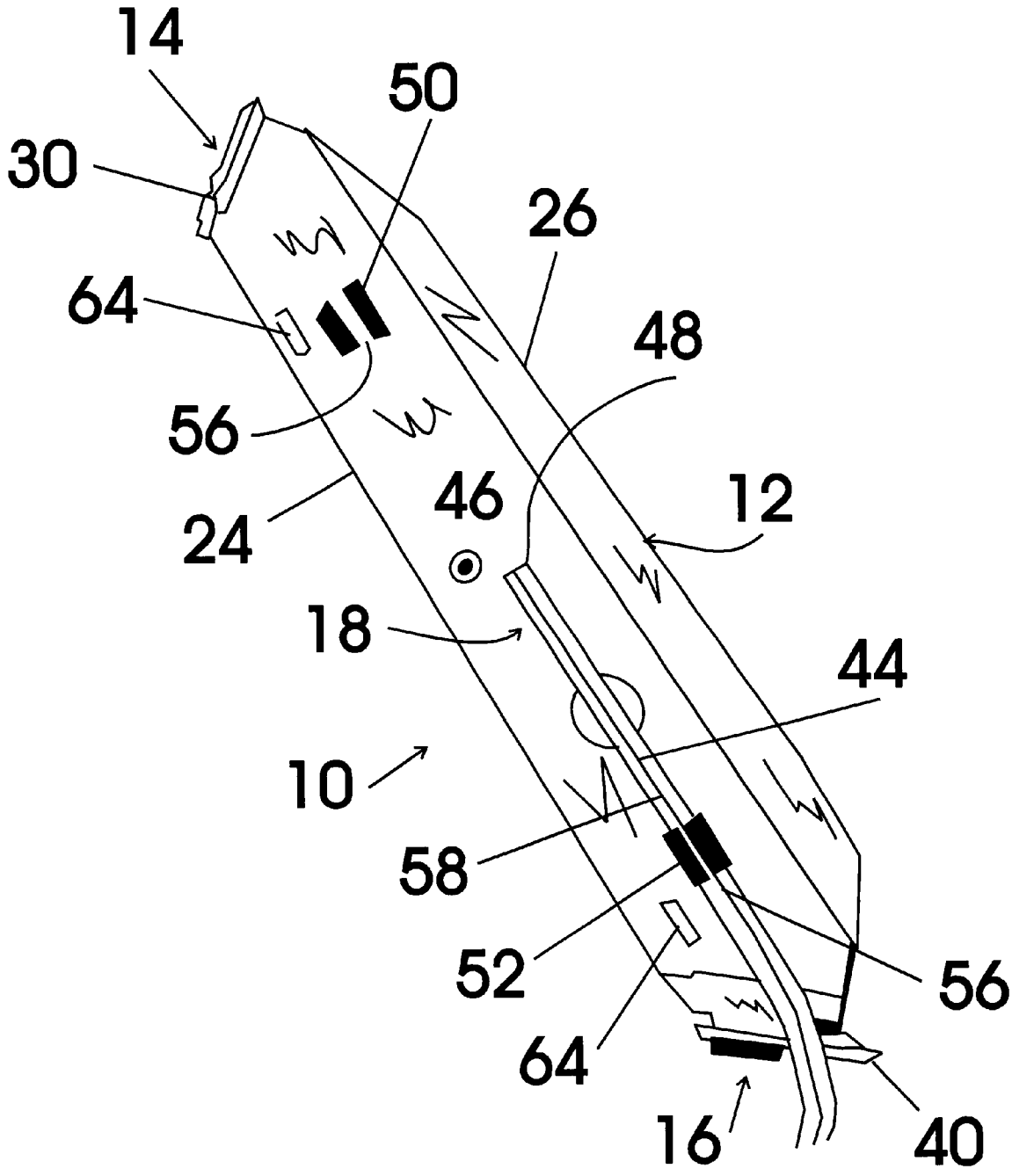
FIG. 3 is a second side view of the motor housing showing the three-position on/off switch, the fan assembly positioned within an air intake vent formed within the motor housing and two of the four air vent openings.

FIGS. 1–4 illustrate an exemplary embodiment of the dual blade hair clipper system of the present invention, generally designated 10. With reference to FIGS. 1–3, dual blade hair clipper system 10 includes a two-piece, molded plastic, motor housing, generally designated 12; an independently powered edger unit, generally designated 14; an independently powered taper unit, generally designated 16; a power cord directing assembly, generally designated 18; a three-position on/off switch, generally designated 20; and a motor cooling system, generally designated 22.

Figure 4:
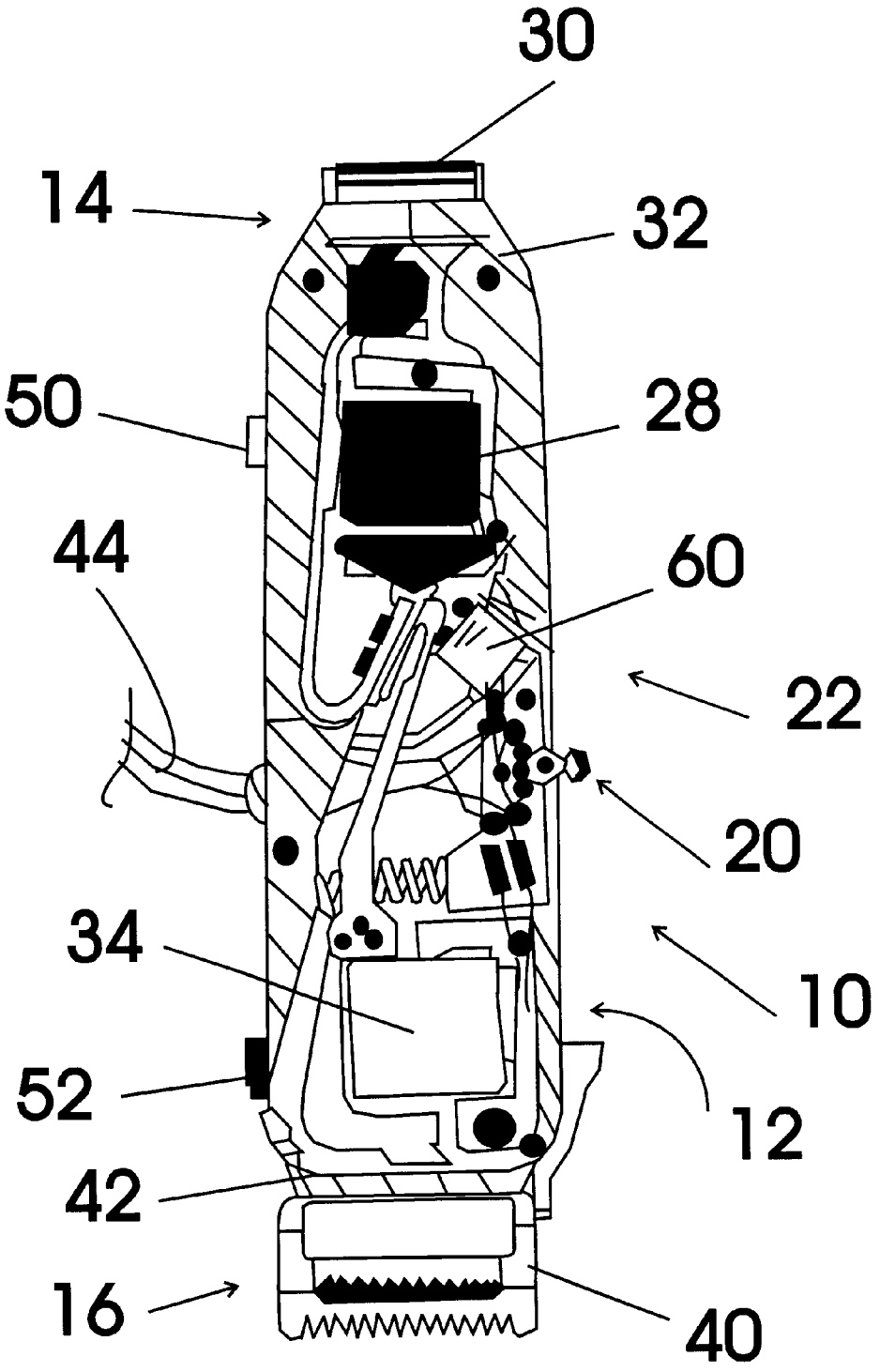
FIG. 4 is a top view of the dual blade clipper system with a top section of the motor housing removed to reveal the taper unit drive motor and the edger unit drive motor.

Motor housing 12 includes a top section 24 and a bottom section 26 that are sized to provide a handle graspable by a hand of a user. Referring now also to FIG. 4, independently powered edger unit 14 includes a ten Watt, edger unit drive motor 28 housed within motor housing 12 and an edger blade assembly 30, powered by edger unit drive motor 28, provided at one end 32 of motor housing 12. Independently powered taper unit 16 includes a twelve Watt, taper unit drive motor 34 housed within motor housing 12 and an adjustable taper blade assembly 40, powered by taper unit drive motor 34, provided at an opposite end 42 of motor housing 12.

Power cord directing assembly 18 includes a power cord 44 extending out from a side surface 46 of motor housing 12 midway 48 between edger blade assembly 30 and taper blade assembly 40 and two cord securing clips 50,52. Each cord securing clip 50,52 has a lateral insertion opening 56 through which a section 58 of power cord 44 is snap fit to form a connection between the section 58 of power cord 44 and the cord securing clip 50,52.

Three-position on/off switch 20 is wired in controlling connection with taper unit drive motor 34 and edger unit drive motor 28 such that in a first switch position taper unit drive motor 34 is on, in a second switch position edger unit drive motor 28 is on, and in a third switch position both taper unit drive motor 34 and edger unit drive motor 28 are off. Motor cooling system 22 includes a fan assembly 60 positioned within motor housing 12 and in air flow connection with four air vent openings 64 formed through motor housing 12 such that operation of fan assembly 60 causes air to flow into, through and out of motor housing 12 passing through one of the air vent openings 64. Air vent openings 64 are positioned on motor housing 12 such that air flow is directed onto edger unit drive motor 28 and taper unit drive motor 34. Fan assembly 60 is in controlled connection with three-position switch 20 such that fan assembly 60 operates when three-position switch 20 is in the first and second switch positions.

It can be seen from the preceding description that a dual blade hair clipper system has been provided that includes a motor housing, an independently powered edger unit, an independently powered taper unit, a power cord directing assembly, a three-position on/off switch, and a motor cooling system; the motor housing being sized to provide a handle graspable by a hand of a user; the independently powered edger unit including an edger unit drive motor housed within the motor housing and an edger blade assembly, powered by the edger unit drive motor, provided at one end of the motor housing; the independently powered taper unit including a taper unit drive motor housed within the motor housing and an adjustable taper blade assembly, powered by the taper unit drive motor, provided at an opposite end of the motor housing; the power cord directing assembly including a power cord extending out from a side surface of the motor housing midway between the edger blade assembly and the taper blade assembly and two cord securing clips, one of the two cord securing clips being provided on either side of a power cord motor housing exit point; each cord securing clip having a lateral insertion opening through which a section of the power cord is snap fit to form a connection between the section of power cord and the cord securing clip; the three-position on/off switch being wired in controlling connection with the taper unit drive motor and the edger unit drive motor such that in a first switch position the taper unit drive motor is on, in a second switch position the edger unit drive motor is on, and in a third switch position both the taper unit drive motor and the edger unit drive motor are off; the motor cooling system including a fan assembly positioned within the motor housing and in air flow connection with a number of air vent openings formed through the motor housing such that operation of the fan assembly causes air to flow into, through and out of the motor housing; the air vent openings being positioned on the motor housing such that air flow is directed onto the edger unit drive motor and the taper unit drive motor; the fan assembly being in controlled connection with the three-position switch such that the fan assembly operates when the three-position switch is in the first and second switch positions.

It is noted that the embodiment of the dual blade hair clipper system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A dual blade hair clipper system comprising:

a motor housing;

an independently powered edger unit;

an independently powered taper unit;

a power cord directing assembly;

a three-position on/off switch; and a motor cooling system;

said motor housing being sized to provide a handle graspable by a hand of a user;

said independently powered edger unit including an edger unit drive motor housed within said motor housing and an edger blade assembly, powered by said edger unit drive motor, provided at one end of said motor housing;

said independently powered taper unit including a taper unit drive motor housed within said motor housing and an adjustable taper blade assembly, powered by said taper unit drive motor, provided at an opposite end of said motor housing;

said power cord directing assembly including a power cord extending out from a side surface of said motor housing midway between said edger blade assembly and said taper blade assembly and two cord securing clips, one of said two cord securing clips being provided on either side of a power cord motor housing exit point;

each cord securing clip having a lateral insertion opening through which a section of said power cord is snap fit to form a connection between said section of power cord and said cord securing clip;

said three-position on/off switch being wired in controlling connection with said taper unit drive motor and said edger unit drive motor such that in a first switch position said taper unit drive motor is on, in a second switch position said edger unit drive motor is on, and in a third switch position both said taper unit drive motor and said edger unit drive motor are off;

said motor cooling system including a fan assembly positioned within said motor housing and in air flow connection with a number of air vent openings formed through said motor housing such that operation of said fan assembly causes air to flow into, through and out of said motor housing;

said air vent openings being positioned on said motor housing such that air flow is directed onto said edger unit drive motor and said taper unit drive motor;

said fan assembly being in controlled connection with said three-position switch such that said fan assembly operates when said three-position switch is in said first and second switch positions.

* * * * *